US006547575B2

(12) United States Patent
Kato et al.

(10) Patent No.: US 6,547,575 B2
(45) Date of Patent: Apr. 15, 2003

(54) ELECTRONIC EQUIPMENT AND HINGE CONNECTOR USED FOR THE SAME

(75) Inventors: Nobukazu Kato, Fussa (JP); Kazuhito Hisamatsu, Hino (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/025,021

(22) Filed: Dec. 19, 2001

(65) Prior Publication Data

US 2002/0080548 A1 Jun. 27, 2002

(30) Foreign Application Priority Data

Dec. 21, 2000 (JP) ..... 2000-389430

(51) Int. Cl.[7] ..... H01R 3/00
(52) U.S. Cl. ..... 439/165
(58) Field of Search ..... 439/165, 162, 439/67, 77, 31; 361/755, 103, 104; 16/223

(56) References Cited

U.S. PATENT DOCUMENTS 5,390,075 A * 2/1995 English et al. ..... 439/165
5,681,176 A * 10/1997 Ibaraki et al. ..... 439/165
5,995,373 A * 11/1999 Nagai ..... 361/755
6,079,993 A * 6/2000 Laine ..... 439/165
6,439,905 B2 * 8/2002 Andrews et al. ..... 439/165
6,447,314 B1 * 9/2002 Kato et al. ..... 361/755

* cited by examiner

*Primary Examiner*—Gary Paumen
(74) *Attorney, Agent, or Firm*—Michael Best & Friedrich LLC

(57) ABSTRACT

In the hinge connector used for an electronic equipment, a first housing has a first hinge connector portion 75 in a hinge unit 27, and a second housing a second hinge connector portion 77 in the hinge unit 27. The second hinge connector portion 77 is housed in the hinge unit 27 slidably between a position in which the hinge connector portion is housed in the hinge unit 27 and a position in which the hinge connector portion projects out from the hinge unit 27, the first housing and second housing being mechanically combined together, the first and second hinge connector portions being then connected together by slidingly moving the second hinge connector portion in the direction crossing the mentioned combining direction at right angles thereto, the first housing and second housing being thereby electrically connected together. This structure enables a hinge connector capable of preventing damage to the connector portions, i.e. electrically combined portions, which would occur when housings of an electronic equipment are mechanically combined with the connector portions constituting portions to be electrically combined, by separating from each other a structure of the portions to be electrically combined and that of portions to be mechanically combined; and an electronic equipment using the same hinge connector to be provided.

22 Claims, 13 Drawing Sheets

ELECTRONIC EQUIPMENT AND HINGE CONNECTOR USED FOR THE SAME

BACKGROUND OF THE INVENTION (1) Field of the Invention

This invention relates to an electronic equipment and a hinge connector used for the same, and more particularly to an electronic equipment provided with two openable housings, and a hinge connector electrically connecting the two housings together.

(2) Description of the Related Art

A hinge connector has heretofore been used for hinge portions by which a pair of openable housing structures of an electronic equipment, such as a note type personal computer and a portable telephone, are connected together openably, electrically and mechanically.

For example, a note type personal computer, which will hereinafter be referred to as a note type PC, is provided with a PC body, a liquid crystal display, which will hereinafter be referred to as LCD, and a hinge unit adapted to connect housings of the LCD and PC body together so that these housings can be pivotally moved. The PC body is provided with a housing, in which a keyboard integral therewith is provided. The LCD is formed of a housing provided with a front frame 21 and a liquid crystal display (LCD) body.

Each hinge unit is provided with hinge portions, and cylindrical portions provided on each housing. At least one hinge portion houses therein a hinge connector for electrically connecting a LCD body and a PC body together. The hinge connector is joined at one end thereof to a connector provided on the PC body, and at the other end thereof to the LCD.

Such a related art hinge connector is provided with a pair of one-end-opened connector cylinders to be mutually engaged with each other. Each of the connector cylinders is provided with a radially projecting and axially extending linear gutter-like fitting portion made integral therewith. A flexible printed board (FPC) is wound by bending an intermediate portion thereof, and this wound portion is housed in the connector cylinder. Both end portions of the flexible printed board are formed as connectors, which are housed in the fitting portions respectively and supported fixedly therein.

In the above-described related art hinge connector, the mechanical connection and electrical connection of the housings are made in the same direction. In such a structure, a high stress is imparted to an electrically connecting portion in some cases. In such a case, it was necessary to give a sufficient strength to the electrically connecting portion, i.e. a connector portion, or have a sufficiently skilled worker carry out the connection operation.

In order to give a sufficient strength to a hinge connector, the dimensions of thereof necessarily become large, and such a large hinge connector proved unsuitable for a small-sized portable equipment.

The end users' selecting a unit for an electronic equipment by themselves have been increasingly demanded as a new recent tendency. Since the operations for meeting such a demand cannot be carried out by anybody except a skilled worker, it has been impossible to satisfy what the users desire.

In the assembling of a unit for an electronic equipment, it is necessary that a stable electric performance thereof be secured in a small space. Furthermore, a concept of forming a unit so that the unit can be replaced simply with another has been demanded.

SUMMARY OF THE INVENTION

It is an object of the present invention to provide a hinge connector apable of preventing damage to connector portions, which would occur when housings of an electronic equipment are mechanically joined to the connector portions constituting electrically connecting portions, by separating a structure of an electrically connecting portion and that of a mechanically connecting portion from each other.

It is another object of the present invention to provide an electronic equipment using this hinge connector.

According to an aspect of the present invention, there is provided an electronic equipment which has a first housing and a second housing connected together by a hinge unit so that the housings can be pivotally moved. The first housing has a first hinge connector portion in the hinge unit. The second housing has a second hinge connector portion in the hinge unit. The second hinge connector portion is housed in the hinge unit so that the second hinge connector portion can be slidingly moved between a position in which the second hinge connector portion is housed therein and a position in which the second hinge connector portion projects out therefrom. The first housing and second housing are connected together mechanically. The first and second hinge connector portions are thereafter connected together by slidingly moving the second hinge connector portion in the direction crossing this connecting direction at right angles thereto. The first housing and second housing are thereby connected together electrically.

In this electronic equipment and according to the present invention, the first hinge connector portion and second hinge connector portion are preferably formed so that they are in a connected condition and pivotable when the first housing and second housing are pivotally moved.

According to another aspect of the present invention, there is provided a hinge connector used in such a hinge unit as mentioned above of an electronic equipment in which a first housing and a second housing are connected together pivotably by the hinge unit has a first hinge connector portion and a second hinge connector portion. The first hinge connector portion has a first insulator and a first FPC held on a circumference of an inner surface of the first insulator and provided with a first connecting portion to be joined to the second hinge connector portion. The second hinge connector portion has a second insulator and a second FPC held on a circumference of an outer surface of the second insulator and provided with a second connecting portion to be joined to the first hinge connector portion.

In this invention, the first and second insulators are preferably formed to a mutually engageable cylindrical or cross-sectionally polygonal shape.

DESCRIPTION OF THE PREFERRED EMBODIMENTS

Before describing the embodiments of the present invention, a related art hinge connector will be described with reference to the drawings so as to have the present invention understood easily.

Figure 1:
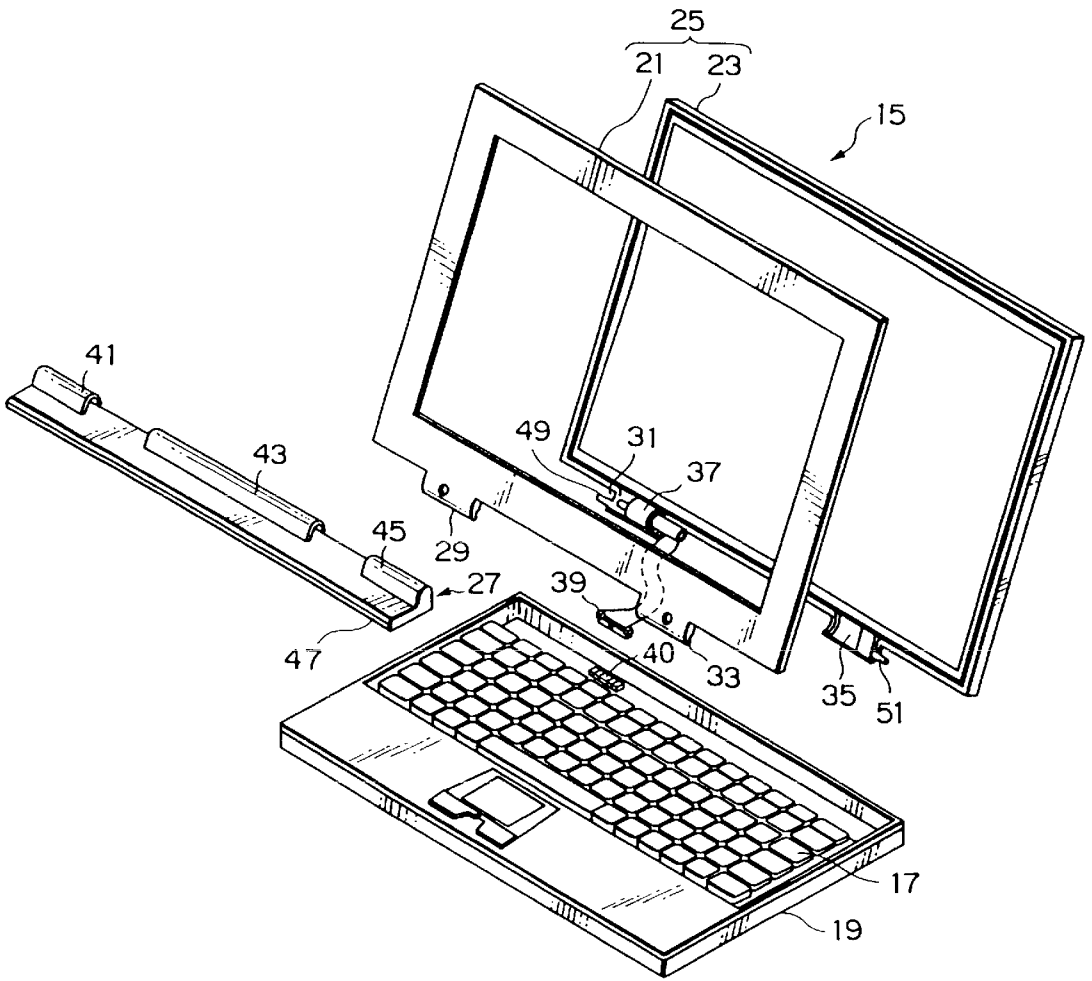
FIG. 1 PRIOR ART
FIG. 1 is an exploded assembly drawing in perspective of a hinge unit for a note type personal computer.

Referring to FIG. 1, a note type personal computer 15, which will hereinafter be referred to as a note type PC, is provided with a PC body 19, a liquid display 25, which will hereinafter be referred to as a LCD, and a hinge unit 27 connecting housings of the LCD 25 and PC body 19 together so that these housings can be pivotally moved. The PC body 19 is provided with a housing in which a keyboard 17 made integral therewith is provided. The LCD 25 is formed of a housing provided with a front frame 21, and a liquid crystal display (LCD) body 23.

The front frame 21 and LCD body 23 are provided at lower ends thereof with hinge portions 29, 31 and 33, 35, respectively. The respective hinge portions 29, 31 and 33, 35 are superposed on each other, and fitted in cylindrical portions 41, 43, 45 which form a hinge unit 27 fixed with the hinge portions. At least one hinge portion 29, 31 houses therein a hinge connector 37 for electrically connecting the LCD body 31 and PC body 19 together. One end 39 of the hinge connector 37 is joined to a connector 40 provided on the PC body 19, while the other end (not shown) thereof is joined to the LCD 25. Herein, reference numerals 49, 51 denote rotary shafts inserted into the hinge unit 27.

A hinge connector used not only for the related art example of FIG. 1 but also for a general related art electronic equipment will now be described.

Figure 2:
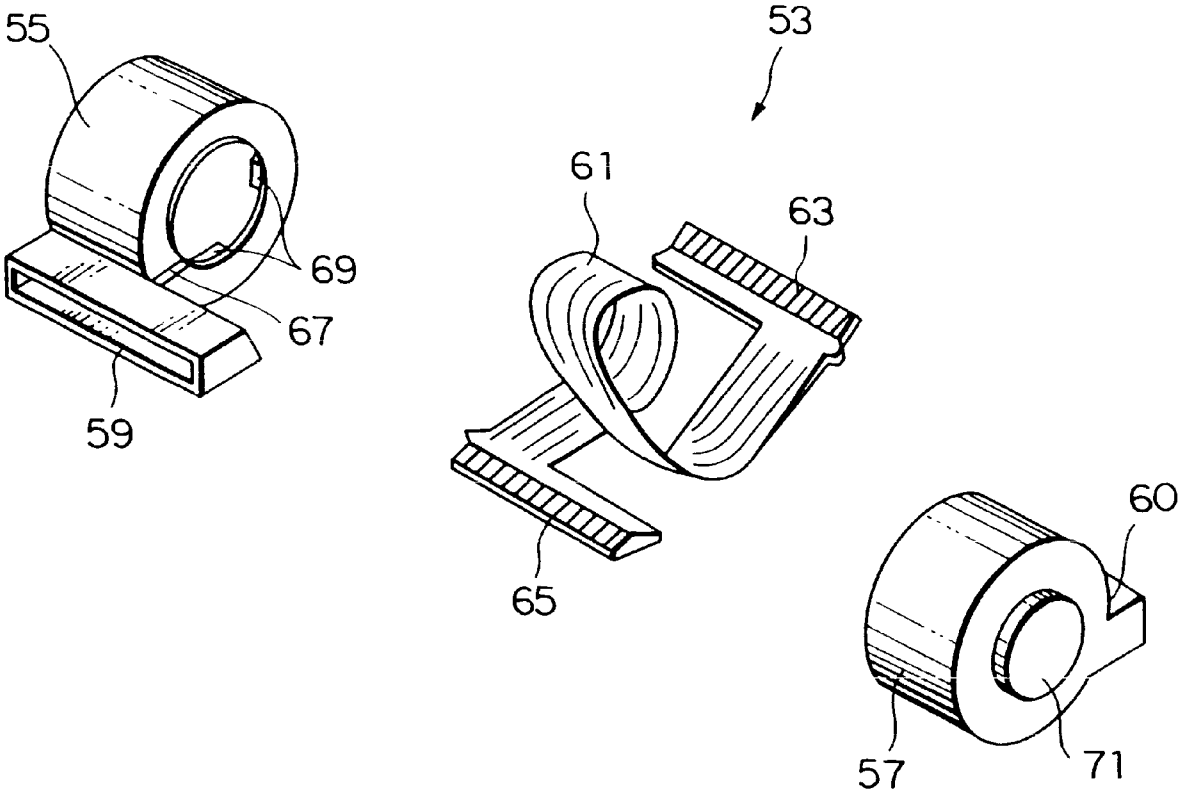
FIG. 2 PRIOR ART
FIG. 2 is an exploded assembly drawing in perspective showing a related art hinge connector, which is other than the example of FIG. 1, used for a general electronic equipment.
Figure 3:
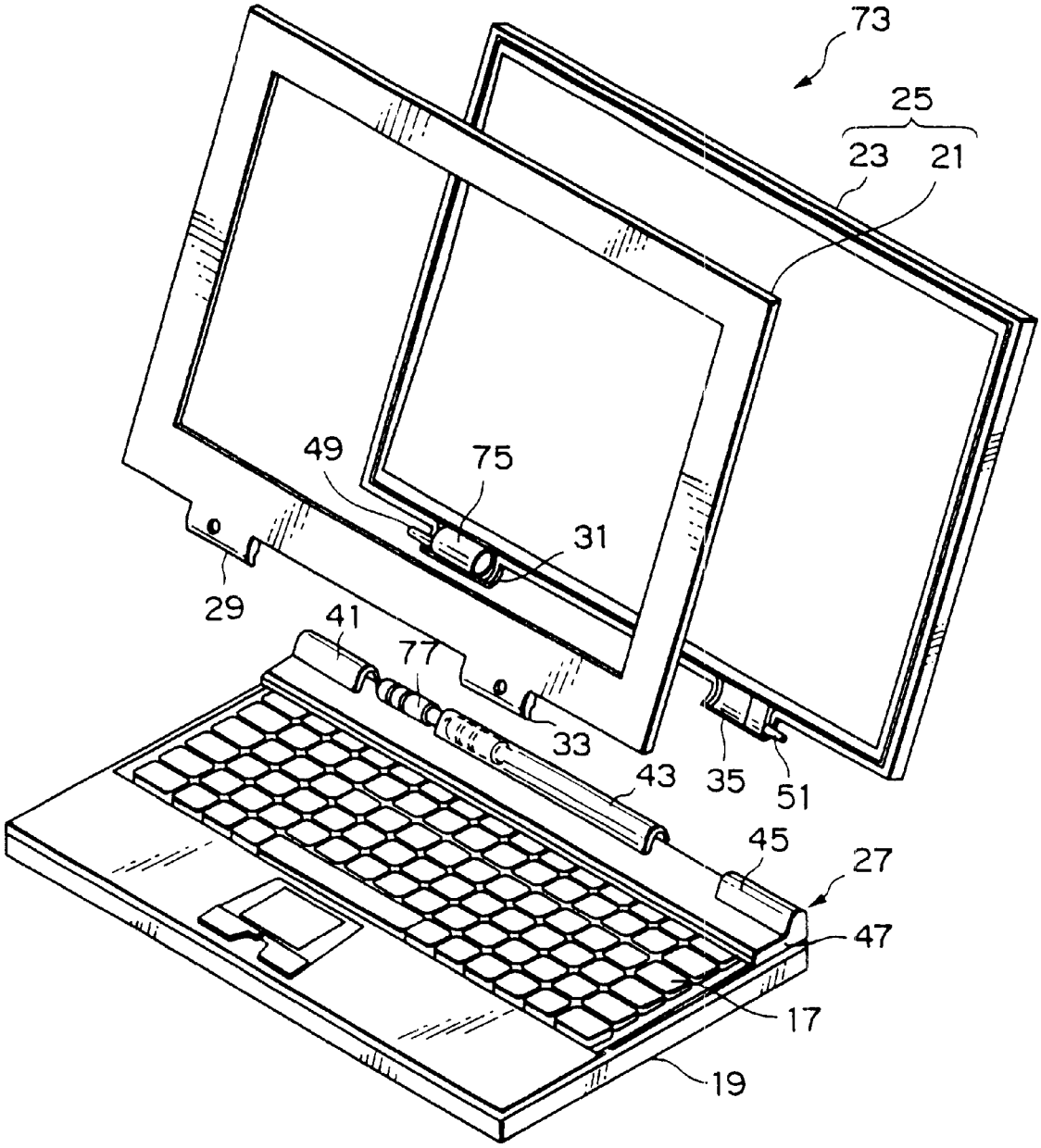
FIG. 3 is an exploded assembly drawing in perspective showing a note type PC as an example of an electronic equipment on which a hinge connector of a first embodiment of the present invention is mounted.
Figure 4:
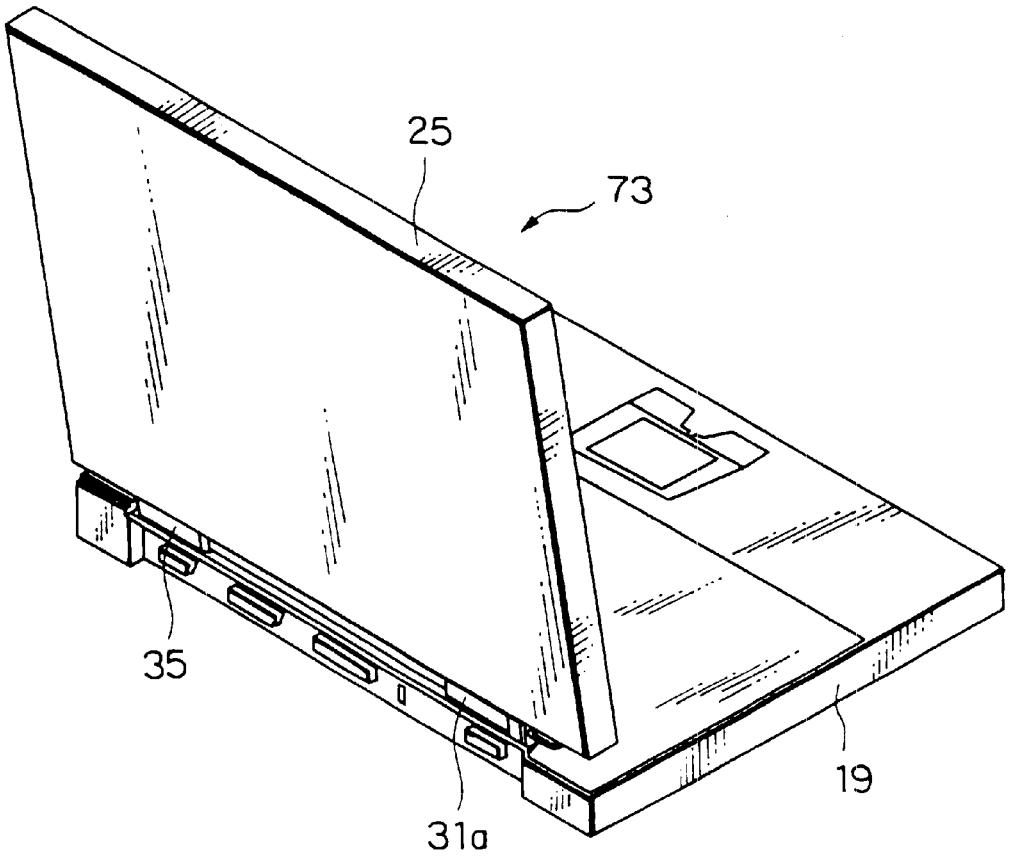
FIG. 4 is a perspective view taken from a rear side of the note type PC of FIG. 3.

Referring to FIG. 2, a hinge connector 53 is provided with a pair of connector cylinders 55, 57 which are to be engaged with each other, and which are opened at one end of each thereof. The connector cylinders 55, 57 are provided with radially projecting axially extending linear gutter-like fitting portions 59, 60 made integral therewith. A flexible printed board 61 is wound by bending an intermediate portion thereof, and this wound portion is fitted in the connector cylinders 55, 57. Both end portions of the flexible printed board 61 are formed as connectors 63, 65, which are housed and supported fixedly in the fitting portions 59, 60. As shown in the illustration of the connector cylinder 55 only, each of the connector cylinders 55, 57 is provided with a slit 67 for inserting the flexible printed board 61 thereinto, and locking members 69 for setting the two connector cylinders freely movable around the axes thereof and uniting the same connector cylinders with each other in the axial direction thereof. As shown in the illustration of the connector cylinder 57 only, each of the connector cylinders is provided with a shaft portion 71 for housing the two united connector cylinders 55, 57 in and between lower bearings (not shown) so that the connector cylinders can be turned.

The embodiments of the present invention will now be described with reference to FIGS. 3–13D.

Referring to FIGS. 3–6, a note type PC 73 of a first embodiment of the present invention is provided with a liquid display 25, which will hereinafter be referred to as a LCD, and a PC body 19 which are provided with respective housings capable of being opened and closed with respect to each other via a hinge unit 27 and electrically connected to each other.

The electrical connection of the LCD 25 and the PC body 19 to each other is made by a hinge connector 75 provided in the hinge unit 27.

The LCD 25 is provided with the LCD body 23 and a frame 21 superposed on a front surface of this LCD body 23.

The LCD body 23 and frame 21 are provided at their respective lower ends with cross-sectionally semicircular hinge portions 29, 31 and 33, 35. When these hinge portions 29, 33 and 31, 35 are combined with each other, respectively, cross-sectionally circular hinge connector-housing spaces are formed. In at least one pair of hinge portions out of the hinge portions 31, 29 and 35, 33, a space for housing therein a LCD-side hinge connector 75, which will hereinafter be referred to as a first hinge connector portion, electrically connected to the LCD 25 is formed. This space on the side of the LCD 25 houses therein the substantially cylindrical first hinge connector portion 75 provided with a flexible flat cable or a flexible wiring board (which will hereinafter be referred to collectively as a FPC) connected to a circuit in the LCD 25.

One surface as the hinge unit 27 of the PC body 19 is provided with a plate type hinge base portion 47, and hollow cylindrical portions 41, 43, and 45 provided on one surface thereof. In the hollow cylindrical portion 41, a shaft 49 projecting from one end of the first hinge connector portion 75 is inserted, while, in the hollow cylindrical portion 45, a shaft 51 provided on the hinge portion 35 of the LCD 25 is inserted.

At the side of the PC body 19 of the hinge unit 27, an end portion of a PC body-side hinge connector portion (which will hereinafter be referred to as a second hinge connector portion) 77 to be electrically connected to the PC body 19 is housed in the hollow cylindrical portion 43 formed on the hinge base portion 47 formed of a plate body of the hinge unit 27.

This hinge unit 27 is assembled by inserting the shaft 49 of the first hinge connector 75 in the hinge portions 31*a*, 29 and the shaft of the hinge portions 33, 35 into the hollow cylindrical portion 45, and slidingly inserting one end of the second hinge connector portion 77 into the first hinge connector portion 75. The hinge unit is formed so that the housing of the LCD 25 can be turned at a joint portion thereof with respect to that of the PC body 19, i.e., in such a manner that the LCD 25 can be opened and closed as a cover with respect to the PC body 19.

The first and second hinge connector portions 75, 77 are combined with each other when the hinge unit 27 is assembled, and function as a hinge connector for electrically connecting the LCD 25 and PC body 19 together.

Figure 5:
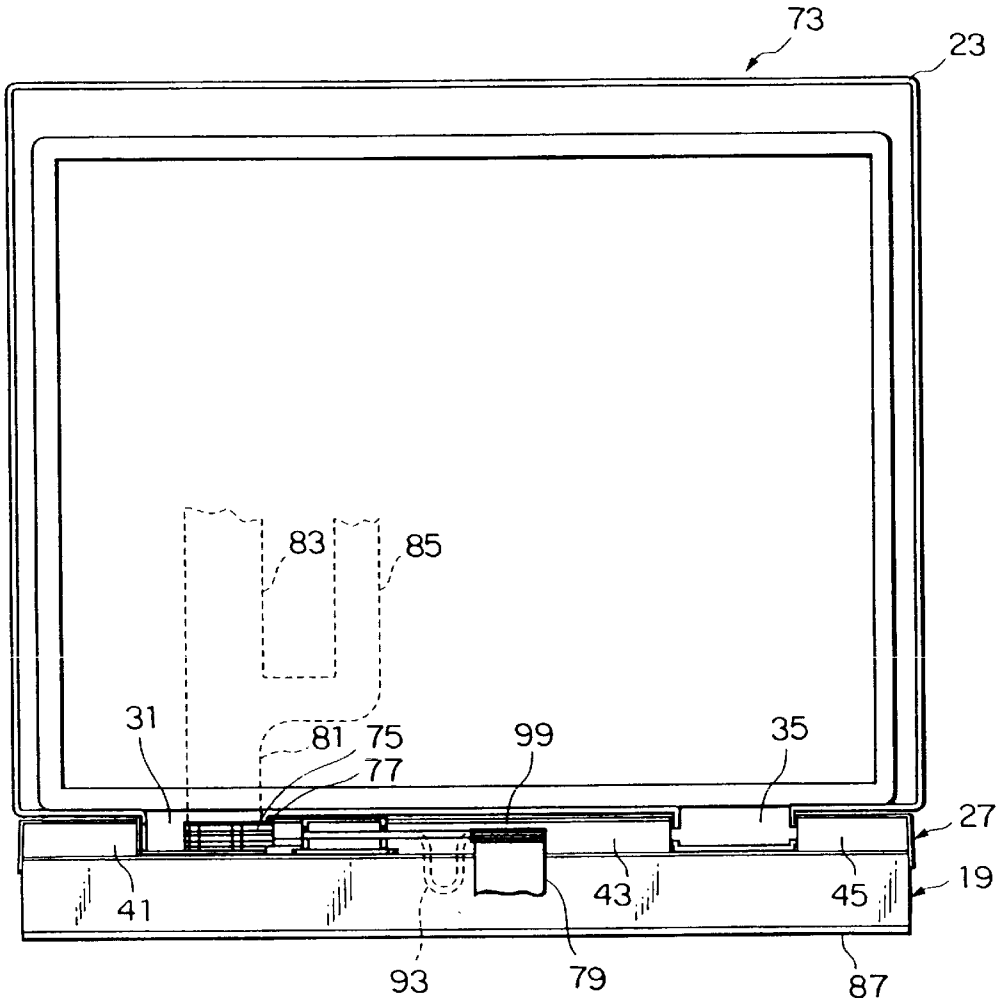
FIG. 5 is a front view showing a region of a LCD and a hinge unit of the note type PC of FIG. 3.
Figure 6:
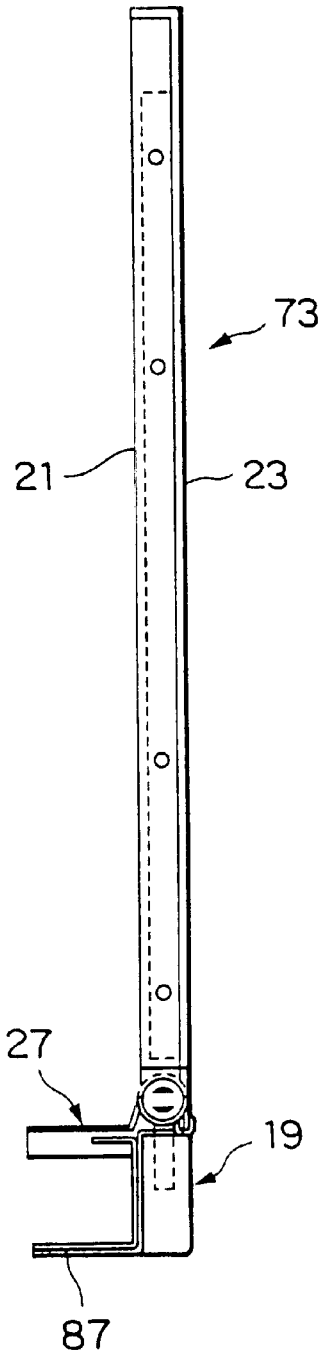
FIG. 6 is a side view of a part including the LCD and hinge unit of FIG. 4 of the note type PC.

Referring to FIGS. 5 and 6, one end of the second hinge connector portion 77 is fitted in the first hinge connector portion 75, and a FPC 79 joined to a connector on the side of the PC body 19 or the interior of the PC body 19 is provided at the other end thereof. The first hinge connector portion 75 is provided with a FPC 81 connected to a circuit of the LCD 25. The FPC 81 is bifurcated to form FPC's 83, 85. A reference numeral 87 denotes a frame on the side of the PC body 19.

Figure 7:
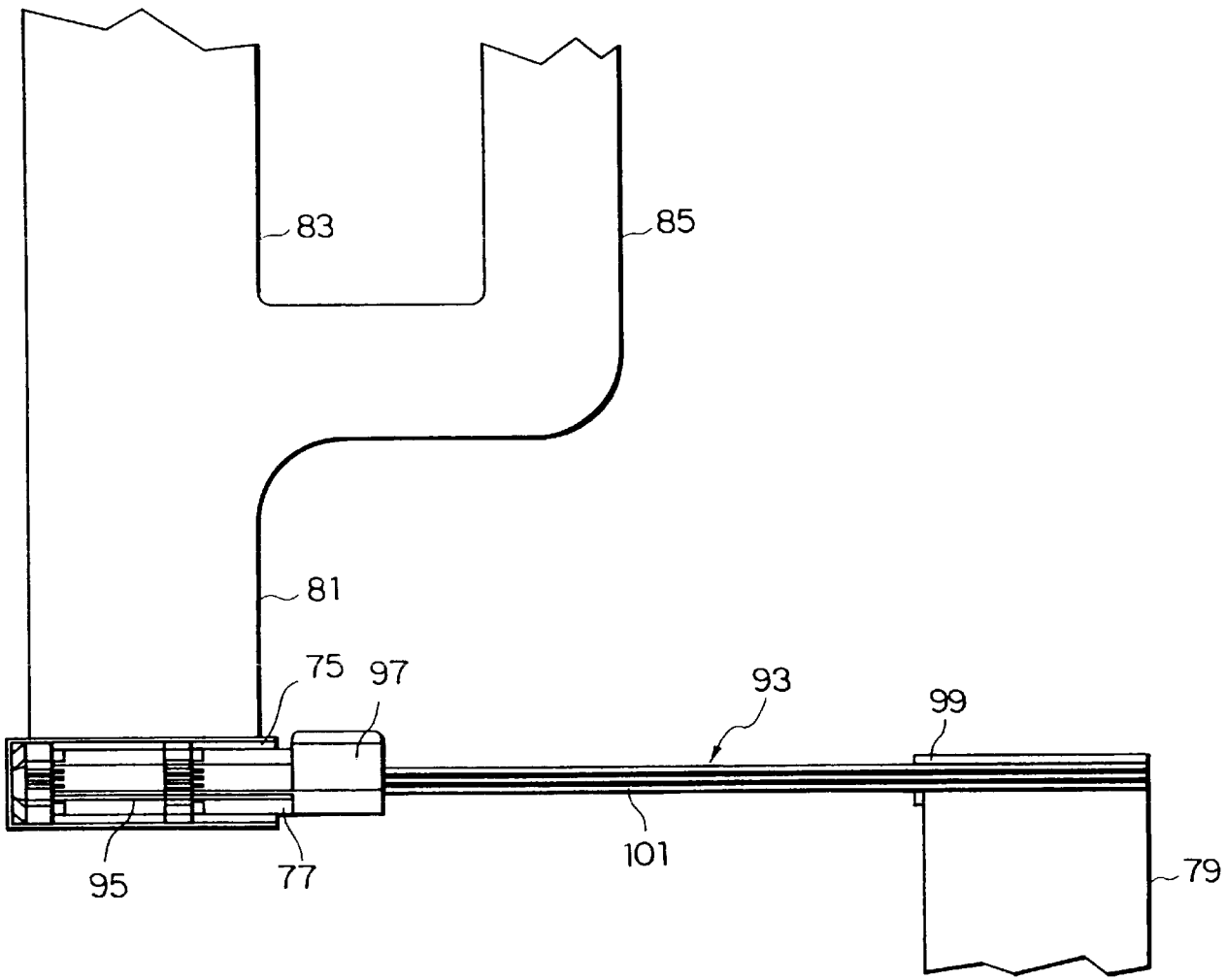
FIG. 7 is a front view showing the hinge connector of FIGS. 3–6.

Referring to FIG. 7, the hinge connector is provided with the first hinge connector portion 75 joined to the FPC 81 on the side of the LCD 25, and the second hinge connector portion 77 fitted and housed at one end portion thereof in the first hinge connector portion with the FPC 79 on the side of the PC body connected to the other end portion thereof.

Figure 8:
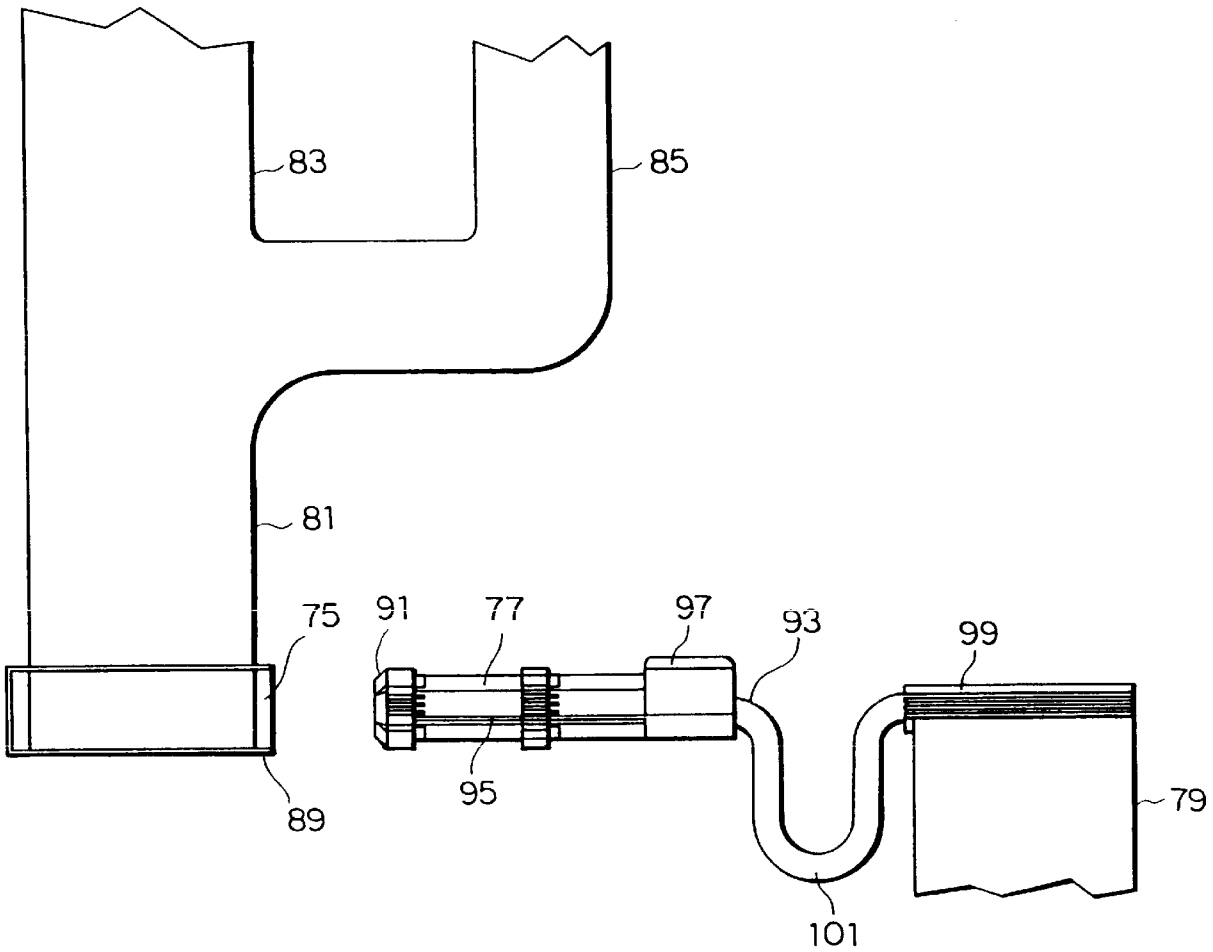
FIG. 8 is an exploded assembly drawing in perspective of the hinge connector of FIG. 6.

As shown in FIG. 8, the first hinge connector portion 75 has a structure formed by fixedly pasting the flexible wiring board on the side of the LCD 25 or the flat cable (FPC) 81 on an inner surface of an insulator, which will hereinafter be referred to as a first insulator, a cylindrically shaped inner surface portion of which is provided with a cavity of a polygonal cross section.

As will be described in detail later, the second hinge connector portion 77 has a structure formed by housing one end portion of a conductive member 93, which is formed of a folded FPC, in the interior of a polygonal column type insulator 91, which will hereinafter be referred to as a second insulator; drawing out the mentioned end portion of the conductive member 93 from a slit 95 formed in the second insulator 91; winding the resultant conductive member 93 around a circumference of the insulator 91; and fixing the leading end portion 93*a* of the conductive member to the slit 95 of the second insulator 91. At the other end portion, which is farther away from an intermediate portion, of the conductive member 93, the FPC 79 connected to the PC body is provided. A reference numeral 97 denotes a stopper, which is inserted into the hollow cylindrical portion 43 (FIG. 3) during an assembling operation, and 99 a nonreturn metal member for the folded conductive member 93.

Thus, the opposed surfaces of the first hinge connector portion 75 and second hinge connector portion 77 are in recess-and-projection-carrying relation, and the recess-carrying and projection-carrying surfaces are in engageable relation depending upon an assembling action. The projections on the housing on one side and recesses in the housing on the opposed contrary side hold connector fitting sections, which are moved in the direction different from that (direction crossing that of the assembling action at right angles thereto) of the assembling action, and a secondary action for the electrical connection is made.

Since the first and second hinge connector portions 75, 77 thus have mutually engageable recesses and projections, the connected condition of the same hinge connector portions 75, 77 can be set stable. The connector fitting sections are formed in and on the recesses and projections, and slidingly moved in the direction crossing the direction, in which the housings are combined together, at right angles thereto, by which the space can be optimized.

Figure 9:
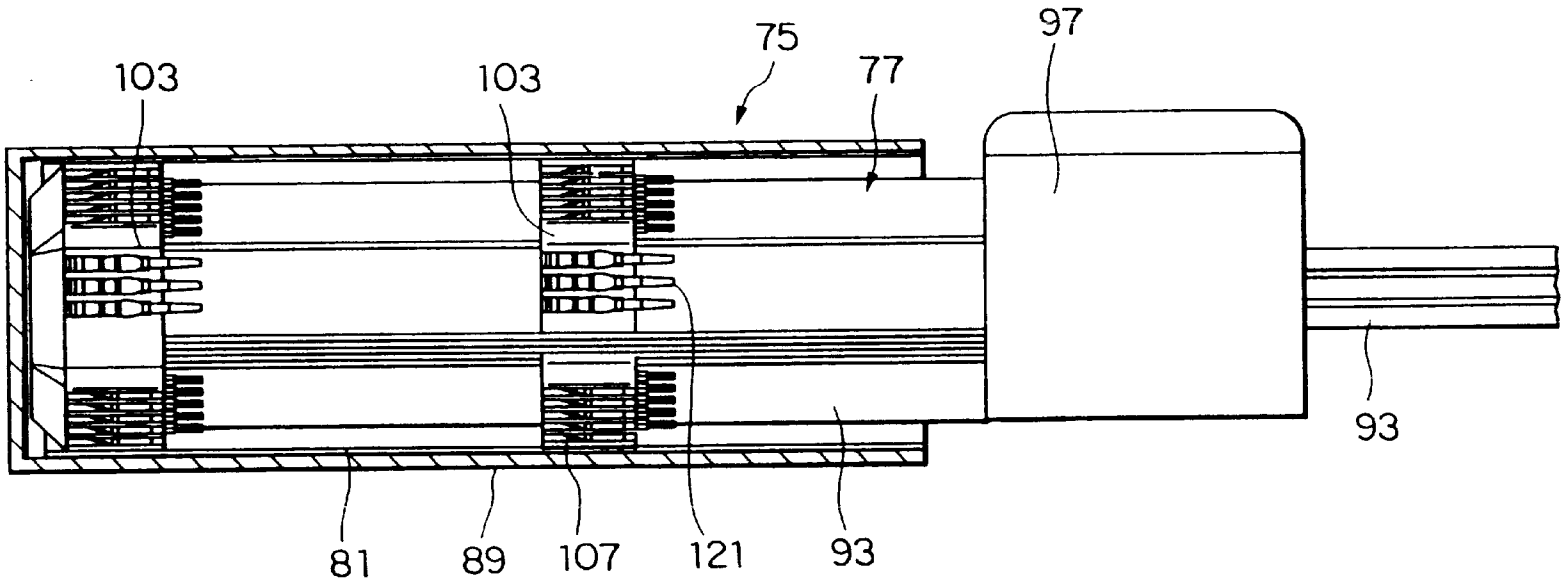
FIG. 9 is an enlarged partial sectional view showing joint sections of first and second hinge connector portions of the hinge connector of FIG. 7.
Figure 10:
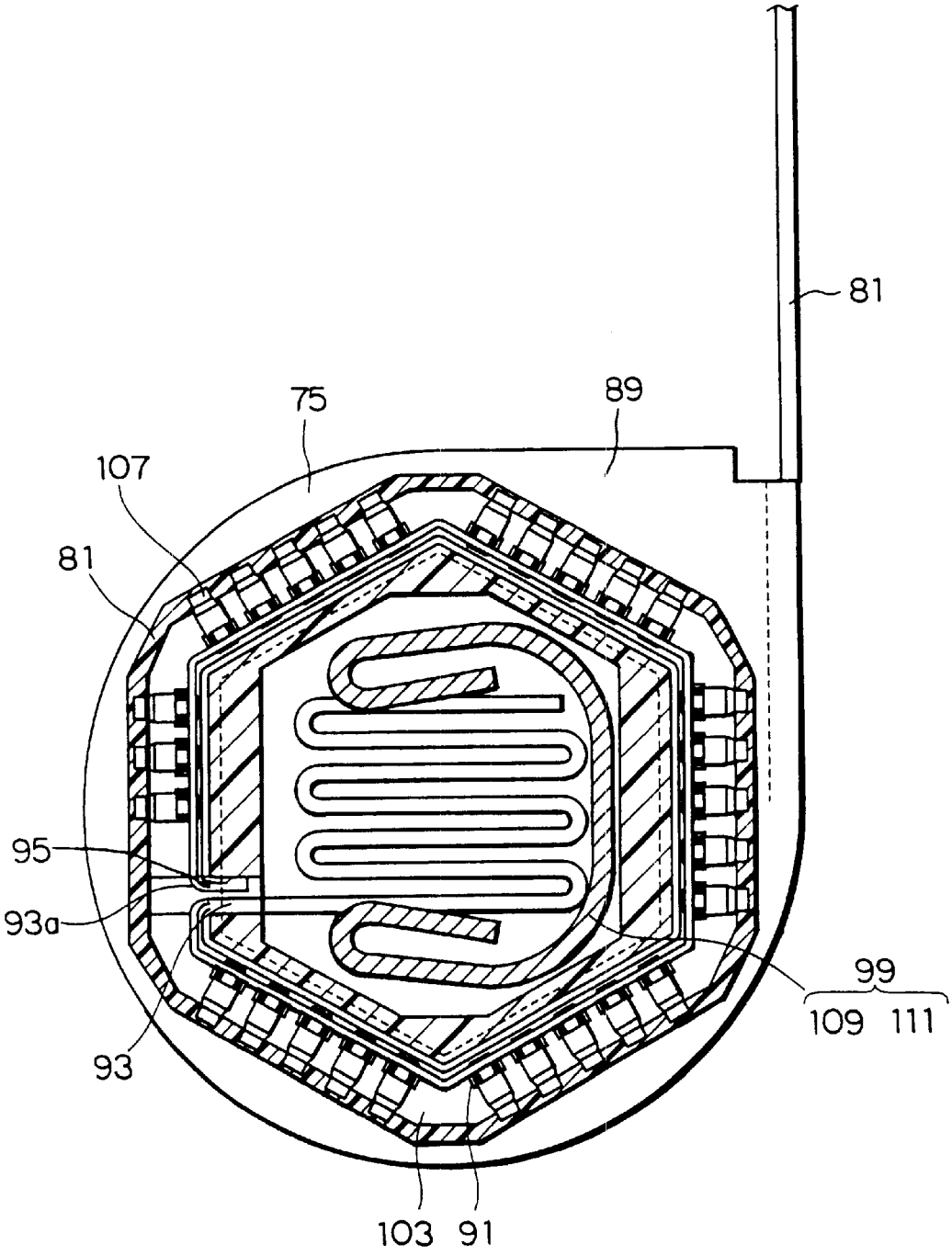
FIG. 10 is a sectional view of the joint sections of the first and second hinge connector portions of FIG. 9.

Referring to FIGS. 9 and 10, the second hinge connector portion 77 is inserted at an end portion of the conductive member 93 into the second insulator 91. A belt-like portion formed of the FPC of the conductive member 93 is drawn out from the slit 95 of the second insulator 91 in the radially outward direction, and wound around the circumference thereof, slits 101 of the conductive member being fitting around projections 103 formed on an outer circumferential portion of the second insulator 91. One end 93*a* of the conductive member 93 is fixed to the slit 95. The contacts 107 are press-fitted in recesses 105 formed among projections 103 of an insulator 91. The ends of the press-fitted contacts 107 are fixed to a pattern of the conductive member 93 by soldering. The electrical connection of the first hinge connector portion 75 and second hinge connector portion 77 together is made by bringing the contacts 107 of the second hinge connector portion 77 into pressure contact when these hinge connector portions are engaged with each other with the FPC 81 pasted on the inner surface, which has a shape of a hexagonal column, of the first insulator 89 of the first hinge connector portion 75. The folded conductive member 93 retains its folded state by C-shaped fixing metal members 109, 111, these are generally designated by a reference numeral 99.

As shown best in FIG. 10, the connecting contacts are formed so that they are arranged along the outer circumference or inner circumference of a shape of a circular column or a polygonal column. Accordingly, each hinge portion of a rotary structure between the hinge connector portions 75, 77 is set rotatable, and has generally a circular shape. When the connector fitting portion is formed in this circular chassis, a structure of the highest efficiency is obtained by forming the connector itself to a circular shape or a shape close to a circular column.

In order to arrange contact springs like the contacts 107 most efficiently, it is optimum that the circular shape is formed so as to extend at one side in the outward direction and at the other side in the inward direction along a contour of a shape close to a shape of a circular column.

The first insulator 89 has at a front end thereof a rectangular column type guide structure adapted to absorb a positional (rotational) deviation. When the combining of the units is done, a positional deviation occurs at the time of an assembling action. In order to absorb this positional deviation at the time of an electrical combining operation, it is necessary that the front end of the connector fitting portion has an induction portion capable of absorbing a positional deviation in X and Y rotational directions. In the embodiment of the present invention, this portion fulfills the function.

Figure 11A:
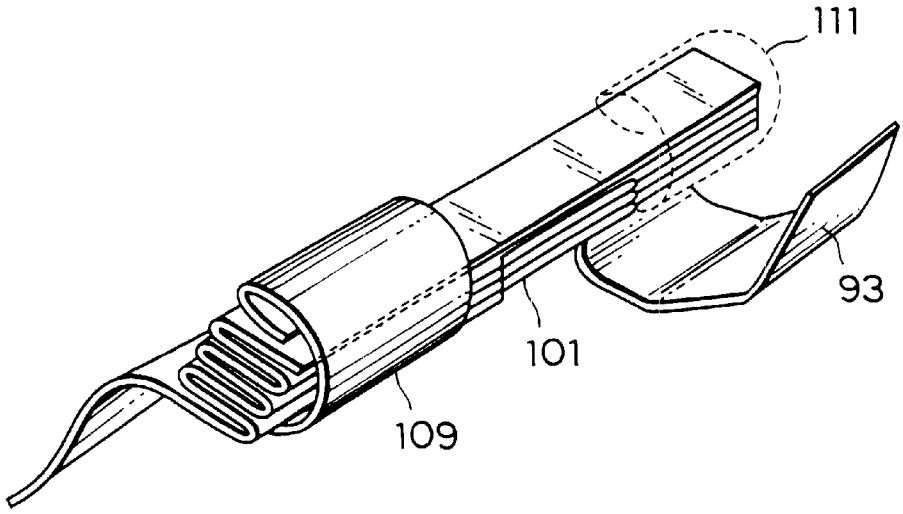
FIG. 11A, FIG. 11B and FIG. 11C are perspective views provided for describing a conductive member used for the second hinge connector portion.

Referring to FIG. 11A, the conductive member 93 used for the second hinge connector 77 is formed by folding a FPC made by providing plural conductors in a plastic sheet, and the parts of this conductive member which are in the vicinity of both ends thereof are fixed by C-shaped fixing metal members 109, 111.

Figure 11B:
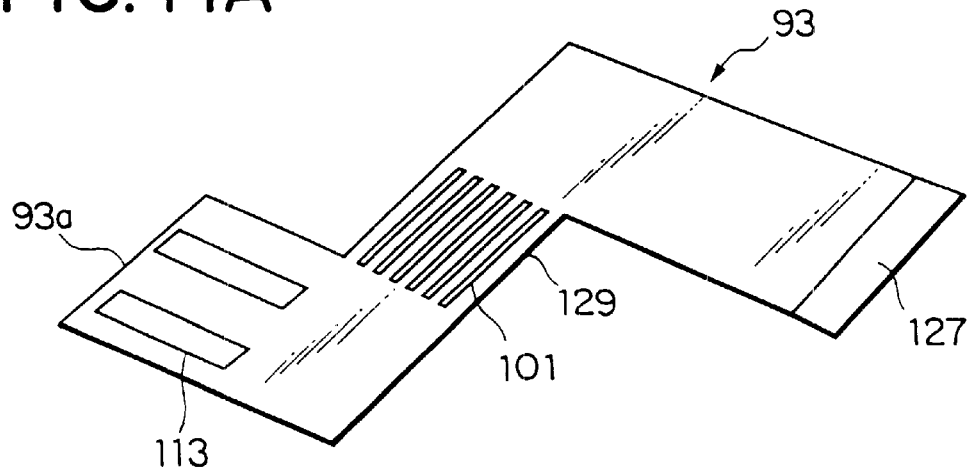

Referring to FIG. 11B, the conductive member 93 in a developed state uses a thin sheet of FPC provided with plural conductors extending so as to draw the letter "S". Both end portions of the conductive member are provided thereon with belt-like thin sheet portions which extend in the direction crossing the longitudinal direction thereof at right angles thereto so that both of the longitudinal end sections of the thin sheet portions extend in the mutually opposite directions. The thin sheet portions are also provided with plural conductors (not shown) extending in the longitudinal direction thereof. The belt-like portion on the side of one end of the conductive member is provided with two slits 113 extending in the direction in which the belt-like portion extends. In an intermediate portion of the conductive member 93, plural slits 101 are formed so as to extend in the longitudinal direction thereof.

As shown in FIG. 11A, the conductive member 93 is folded by bending the same at the portion of the slits 101, and both end portions of the conductive member are fixed by the C-shaped fixing metal members 109, 111. Since slits 101 extending in the longitudinal direction of the conductive member 93 are thus provided, the conductive member 93 folded to the shape of a rod is formed so that the conductive member can be not only rotated or twisted around the axis thereof but also expanded, contracted, bent and slidingly moved in the longitudinal direction thereof.

Figure 11C:
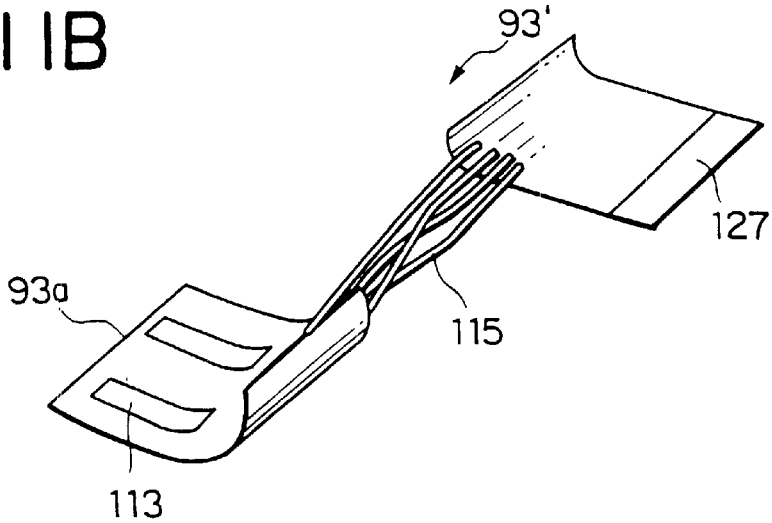

As shown in FIG. 11C, a conductive member 93' may be used which is provided with not slits 101' in an intermediate portion thereof but loose connecting wire rods 115 arranged in the same portion thereof so as to extend in the longitudinal direction.

Since a slitted FPC having a flexibility (rotatability) is used as the conductive member 93, the connecting of the first hinge connector portion 75 and second hinge connector portion 77 together, i.e. the mechanical connection and electrical connection of the housings of the PC body and LCD are carried out in different steps. This enables a rotary portion of the shaft to be formed easily.

When the related art PC body and LCD are formed rotatably with respect to each other, it is necessary that rotatable structures (hinge portions) be employed between the units, so that the unit connecting portions come to have more complicated construction.

Regarding the electrical connection of the hinge unit 27, the parts capable of being formed to a rotatable structure need to have a flexibility so that the parts can work in accordance with a rotational movement of the hinge unit. The slidable parts making a sliding movement also need to have a similar flexibility. The embodiment of the present invention is formed so that the cost and space can be reduced and saved respectively by forming such parts by one conductive member 93.

Figure 12:
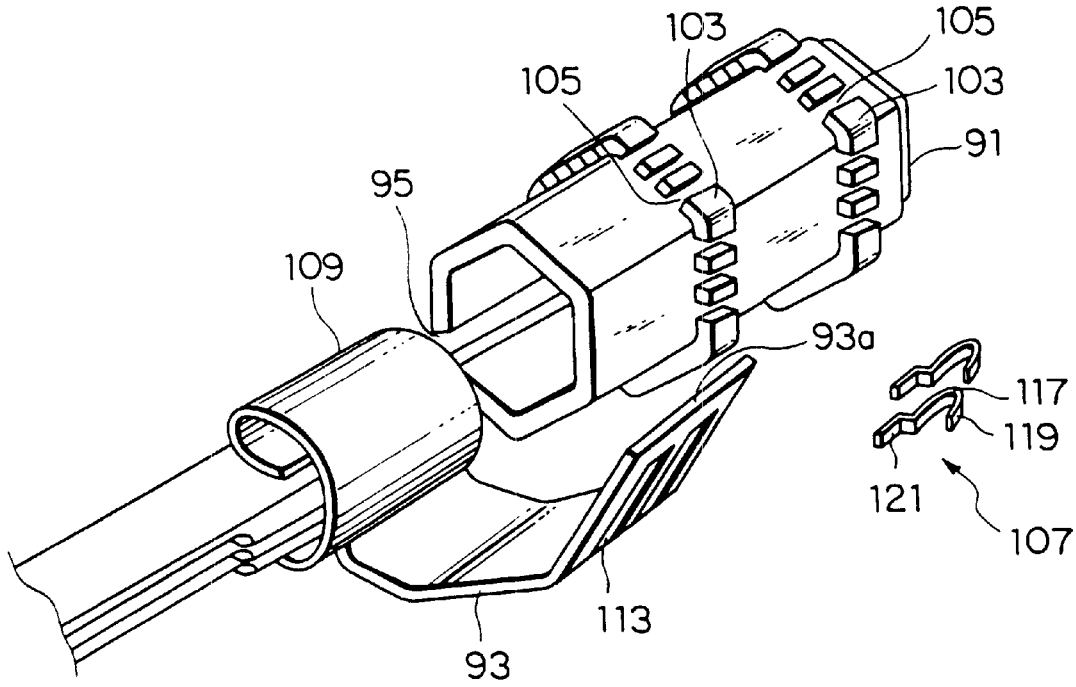
FIG. 12 is a perspective view provided for describing the assembling of a second hinge connector.
Figure 13A:
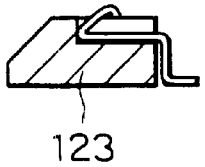
FIGS. 13A and 13B are sectional views showing a method of manufacturing a second hinge connector portion in a second embodiment of the present invention.
Figure 13B:
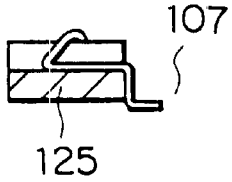
Figure 13C:
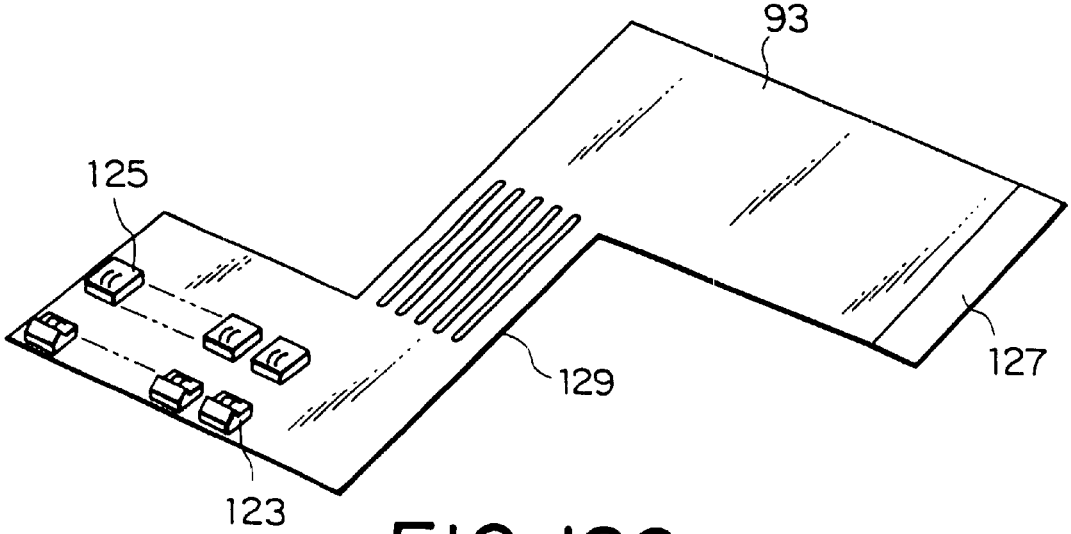
FIGS. 13C and 13D are perspective views showing the method of manufacturing the second hinge connector portion in the second embodiment of the present invention.
Figure 13D:
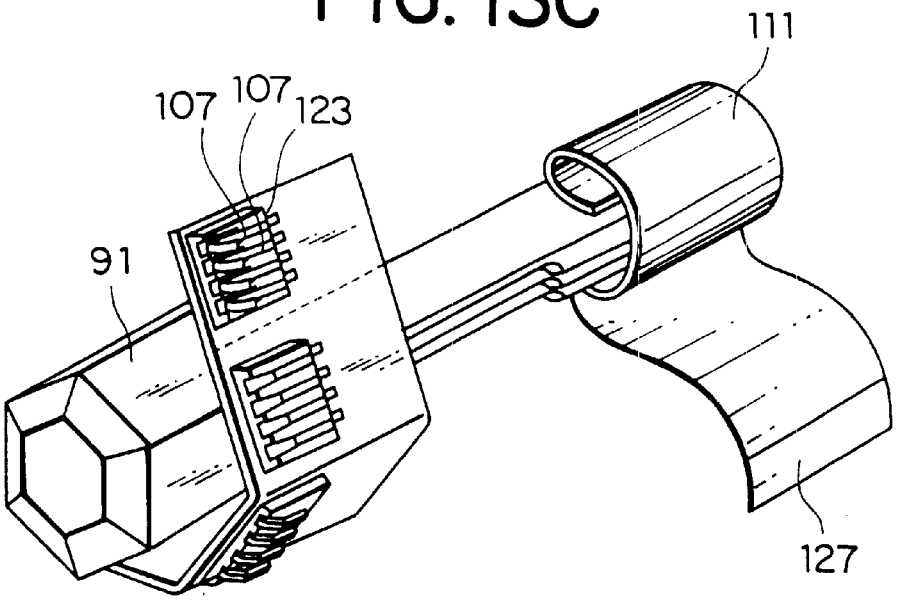

As shown in FIG. 12, one end portion of the conductive member 93 is wound around the substantially hexagonal second insulator 91, which has two rows of projections and a longitudinally extending slit 95, with slits 113 of the former fitted around the projections 103 on the circumference of the latter, and the mentioned end portion of the conductive member is fixed to the slit 95 from which the same end portion was drawn out. A part 117 of the contact 107 is then press-fitted in a recess 105 of the insulator, and contacting portions of the conductive member 93 and contact 107 are soldered together. The contact portion 119 of the contact 107 is engaged under pressure with the LCD-side FPC pasted on the inner surface of the insulator of the first hinge connector portion 75 when the second hinge connector 77 is inserted into the interior of the first hinge connector portion 75, to electrically contact the same.

Thus, the structure of the embodiment of the present invention is formed so that the direction of an effective stroke of the engagement contact crosses the sliding direction of the second hinge connector portion 77 at right angles thereto. Since the contacting stroke of the contact 107 of the connector is made so as to cross the sliding direction at right angles thereto, the connector itself can receive a contacting force.

Regarding the assembling and electrical combining of the hinge connector portions of the PC body 19 and LCD 25, which have their respective electronic circuits, in the hinge connector in the first embodiment of present invention, the electrical combining operation is carried out by a secondary action which is in addition to an assembling action. Namely, since a mechanical combining step and an electrical combining step are separately carried out, a combining method having a compact constitution and capable of being executed by general users can be provided.

In the case of an electronic equipment in which a unit connected to at least one of the hinge connector portions is a display, such as a LCD, and in which a one side unit, such as a portable telephone, a note type personal computer and the like, is a display, it is necessary that a video signal is transmitted between the units. In such a case, the condition which the connector and transmission cable demand is very delicate.

However, in a second embodiment of the present invention, it is possible to attain an optimum electrical condition by carrying out an electric combining operation and a mechanical combining operation in different steps.

A part providing a flexibility between the hinge connector portions is formed by a conductive member 73 of a movable-side second hinge connector portion 77, and so as to be operated also as a movable structure.

Referring to FIGS. 13A–13D, the second embodiment employs a method of combining a FPC of a connector on the side of a PC body 19 and an insulator with each other. In the first embodiment, the end portion of the conductive member 93 was made to creep over the outer circumference of the second insulator 91, and fixed thereon, and the contacts were thereafter press-fitted radially, a terminal and FPC being thereby electrically connected together by soldering.

When the contacts 107 of other insulators 123 are press-fitted in advance of the assembling (folding) of a bent portion 129, which is provided with slits 101, of the conductive member 93 with the terminals and conductive members then electrically connected together in blocks at once by reflow soldering, the manday of the wire connecting operation can be reduced. Reference numerals 123, 125 denote other examples of the fixing portion of the insulator.

According to the embodiments of the present invention, a structure in which the mechanical connection of the housings is made first with the electrical connection thereof made thereafter is employed. Especially, the present invention can provide a hinge connector capable of preventing damage which would occur when a connector portion is mechanically connected to another connector portion, an electrically connecting portion; and an electronic equipment using such a hinge connector.

What is claimed is:

1. An electronic equipment having a first housing and a second housing connected together pivotably by a hinge unit, the first housing having a first hinge connector portion in the hinge unit, the second housing having a second hinge connector portion in the hinge unit, the second hinge connector portion being housed in the hinge unit slidably between a position in which the second hinge connector portion is housed in the hinge unit and a position in which the second hinge connector portion projects out from the hinge unit, the first housing and second housing being mechanically combined together, the first and second hinge connector portions being then connected together by slidingly moving the second hinge connector portion in the direction crossing the mentioned combining direction at right angles thereto, whereby the first housing and second housing are electrically connected together.

2. An electronic equipment according to claim 1, wherein a first hinge connector portion and second a hinge connector portion are formed so that these hinge connector portions are in a connected and pivotable condition when the first housing and second housing are pivotally moved.

3. An electronic equipment according to claim 1, wherein the first hinge connector portion has a first insulator, and a first FPC held by a circumference of an inner surface of the first insulator and provided with a first connecting portion to be joined to the second hinge connector portion, the second hinge connector portion having a second insulator, and a second FPC held by a circumference of an outer surface of the second insulator and provided with a second connecting portion to be joined to the first hinge connector portion.

4. An electronic equipment according to claim 3, wherein the first and second insulators are formed mutually engageably and to a cylindrical or a cross-sectionally polygonal shape.

5. An electronic equipment according to claim 3, wherein the second FPC is formed of one end portion of a conductive member provided with an elongated intermediate portion and both end portions extending in the longitudinal direction of the intermediate portion, the other end portion of the two end portions being formed of a fourth FPC joined to a connector in the second housing or a third FPC.

6. An electronic equipment according to claim 3, wherein the second FPC has at least one slit extending in the longitudinal direction thereof, the second insulator having on a circumference of an outer surface thereof projecting portions engageable with the slit and receiving contacts to be press-fitted thereamong, the contacts being fitted among the projecting portions and fixed after the second FPC is fixed on the projecting portions.

7. An electronic equipment according to claim 3, wherein the second connecting portion is provided with a contact formed of an elongated conductive plate.

8. An electronic equipment according to claim 5, wherein the folded conductive member is folded and provided with a clip fastening the conductive member in the superposing direction thereof.

9. An electronic equipment according to claim 5, wherein the intermediate portion of the conductive member is provided with slits extending in the longitudinal direction of the second FPC, or formed of plural wire rods of conductors, so as to be longitudinally expanded and twisted around an axis of the intermediate portion.

10. An electronic equipment according to claim 4, wherein the mutually engageable first and second insulators have cross-sectionally similar right hexagonal shape.

11. An electronic equipment according to claim 6, wherein the contacts are formed so as to be arranged in two parallel rows in the circumferential direction.

12. A hinge connector used in a hinge unit of an electronic equipment in which a first housing and a second housing are pivotably combined together by the hinge unit, wherein the hinge connector comprises a first hinge connector portion and a second hinge connector portion, the first hinge connector portion having a first insulator, and a first FPC held by a circumference of an inner surface of the first insulator and provided with a first connecting portion to be joined to the second hinge connector portion, the second hinge connector portion having a second insulator, and a second FPC held by an outer circumference of an outer surface of the second insulator and provided with a second connecting portion to be joined to the first hinge connector portion.

13. A hinge connector according to claim 12, wherein the first and second insulators are formed mutually engageably to a cylindrical or a cross-sectionally polygonal shape.

14. A hinge connector according to claim 12, wherein the second FPC is formed of one end portion of a conductive member provided with an elongated intermediate portion and both end portions extending in the longitudinal direction of the intermediate portion, the other end portion of the two end portions being formed of a fourth FPC connected to a connector or a third FPC.

15. A hinge connector according to claim 12, wherein the second FPC has at least one slit extending in the longitudinal direction thereof, the second insulator having on a circumference of an outer surface thereof projecting portions engageable with the slit and receiving contacts to be press-fitted thereamong, the contacts being fitted among the projecting portions and fixed after the second FPC is fixed on the projecting portions.

16. A hinge connector according to claim 12, the second connecting portion is provided with a contact formed of an elongated conductive plate.

17. A hinge connector according to claim 14, wherein the conductive member is folded and provided with a clip fastening the conductive member in the superposing direction thereof.

18. A hinge connector according to claim 14, wherein the intermediate portion of the conductive member is provided with slits extending in the longitudinal direction of the FPC, or formed substantially of plural wire rods of conductors which are formed so that the intermediate portion can be longitudinally expanded or twisted.

19. A hinge connector according to claim 13, wherein the mutually engageable first and second insulators have cross-sectionally similar right hexagonal shape.

20. A hinge connector according to claim 15, wherein the contacts are formed so as to be arranged in two parallel rows in the circumferential direction.

21. A hinge connector according to claim 12, wherein the connector is used for a note type PC.

22. A hinge connector according to claim 12, wherein the connector is used for a portable telephone.

* * * * *

UNITED STATES PATENT AND TRADEMARK OFFICE

CERTIFICATE OF CORRECTION

PATENT NO. : 6,547,575 B2 
DATED : April 15, 2003
INVENTOR(S) : Nobukazu Kato and Kazuhito Hisamatsu It is certified that error appears in the above-identified patent and that said Letters Patent is hereby corrected as shown below:

Title page,
Item [57], ABSTRACT,
Line 3, after "housing" insert -- has --

Column 1,
Line 56, delete "of"

Column 2,
Line 7, delete "apable" and insert -- capable --

Column 3,
Line 16, change "FIG." (first occurrence) to -- FIGS. --
Line 16, delete "FIG." (second occurrence)
Line 16, delete "FIG." (third occurrence)

Column 4,
Line 47, delete "as" and insert -- of --

Column 5,
Line 15, delete "FPC's" and insert -- FPCs --

Column 6,
Line 7, delete "fitting" and insert -- fitted --

Column 7,
Line 18, delete "with not slits 101' " and insert -- without slits 101 --

Column 8,
Line 4, after "of" insert -- the --
Lines 66-67, after "in" delete "the direction crossing the mentioned" and insert -- a direction crossing a --

UNITED STATES PATENT AND TRADEMARK OFFICE

CERTIFICATE OF CORRECTION

PATENT NO. : 6,547,575 B2 
DATED : April 15, 2003
INVENTOR(S) : Nobukazu Kato and Kazuhito Hisamatsu It is certified that error appears in the above-identified patent and that said Letters Patent is hereby corrected as shown below:

Column 9,
Line 4, change "a" (first occurrence) to -- the --
Line 4, change "second a" to -- a second --

Column 10,
Line 30, after "12" insert -- wherein --

Signed and Sealed this

Twenty-ninth Day of July, 2003

JAMES E. ROGAN
*Director of the United States Patent and Trademark Office*